United States Patent [19]

Bessouat et al.

[11] 4,273,077

[45] Jun. 16, 1981

[54] VERTICAL STEAM SEPARATOR-SUPERHEATER

[75] Inventors: Roger Bessouat; Jacques Marjollet, both of Paris, France

[73] Assignee: Stein Industrie, Velizy-Villacoublay, France

[21] Appl. No.: 84,709

[22] Filed: Oct. 15, 1979

[30] Foreign Application Priority Data

Oct. 18, 1978 [FR] France ..... 78 29673

[51] Int. Cl.[3] ..... F22G 1/00

[52] U.S. Cl. ..... 122/483; 122/34; 165/158; 165/163

[58] Field of Search ..... 122/32, 34, 33, 483; 165/134, 158, 163

[56] References Cited

U.S. PATENT DOCUMENTS 3,867,908 2/1975 Byerley et al. ..... 122/32
4,068,627 1/1978 Giesecke et al. ..... 122/34
4,103,647 8/1978 Dorling et al. ..... 122/483

FOREIGN PATENT DOCUMENTS 1399372 2/1975 United Kingdom .

*Primary Examiner*—Edward G. Favors
*Attorney, Agent, or Firm*—Sughrue, Rothwell, Mion, Zinn and Macpeak

[57] ABSTRACT

A vertical steam separator-superheater which has a common casing (1) enclosing a lower separating portion (3) and an upper superheating portion (4). The separator-superheater includes an axial dry steam inlet zone, nests (16, 17) of superheating tubes disposed in envelopes spaced out round the central zone and fixed to a thin flexible casing (30) which is itself fixed to the upper portion of the common casing and an outer superheated steam collection zone (18). The lower portion includes a wet steam inlet chamber (5) and separators grouped in two coaxial truncated pyramide (10, 11).

4 Claims, 3 Drawing Figures

VERTICAL STEAM SEPARATOR-SUPERHEATER

The present invention relates to an improvement in a vertical steam separator-superheater which has a common casing enclosing a lower portion which forms a separation zone and an upper portion which forms a superheating zone, the separator-superheater including an axial dry steam inlet zone, nests of superheating tubes disposed in envelopes spaced out round the central zone and fixed to a thin and flexible casing which is itself fixed to the upper portion of the common casing and a peripheral superheated steam collection zone as claimed in the present assignees' U.S. patent application Ser. No. 950 299 corresponding to their published French patent application Ser. No. 2 406 157.

BACKGROUND

The separator-superheater described in the earlier patent application allows compensation of expansions and contractions of the nests of superheater tubes without any special devices such as expansion bends and makes these nests of superheater tubes easier to remove, when required, for repairs. However the disposition of the separator components grouped in several parallel rows of V-shaped stacks makes access to the inner walls of the lower zone of the separator-superheater more difficult and also requires the inlet tubes for the wet steam which is to be treated to be orientated, since the wet steam must arrive symmetrically with respect to the rows of stacks of separator components.

AIM OF THE INVENTION

The present improvement aims to provide a separator-superheater in which all the inner walls of the lower zone which perform a separating function are readily accessible and whose inlet tubes for the steam to be treated can be orientated as required. It also aims to provide a set of separator components in which the collected water removal units take up very little space.

SUMMARY OF INVENTION

The separator-superheater according to the present improvement is characterized in that the lower portion includes a wet steam inlet chamber which is annular and is connected to wet steam inlet openings and separator components grouped is two coaxial truncated pyramids, the outer pyramid whose large base in lower than its small base and the inner pyramid whose large base is higher than its small base, the annular chamber communicating via an annular passage with the volume between the outer pyramid and the inner pyramid.

It also preferentially has at least one of the following characteristics:

The annular passage which makes the annular inlet chamber communicate with the volume between the outer pyramid and the inner pyramid is bent at about 180° and delimited on an inner side by angularly shifted metal sheets separated by interstices which allow preliminary separation by centrifugal force of part of the water contained in the wet steam;

Units which allow the water collected in the separator components to flow are disposed at the ridges of the truncated pyramids, and Part of the annular passage is formed by the inner wall of the bottom of the common casing.

BRIEF DESCRIPTION OF DRAWINGS

Two vertical steam separator-superheaters in accordance with the invention are described hereinbelow by way of example and with reference to the accompanying drawings.

DESCRIPTION OF PREFERRED EMBODIMENTS

Figure 1:
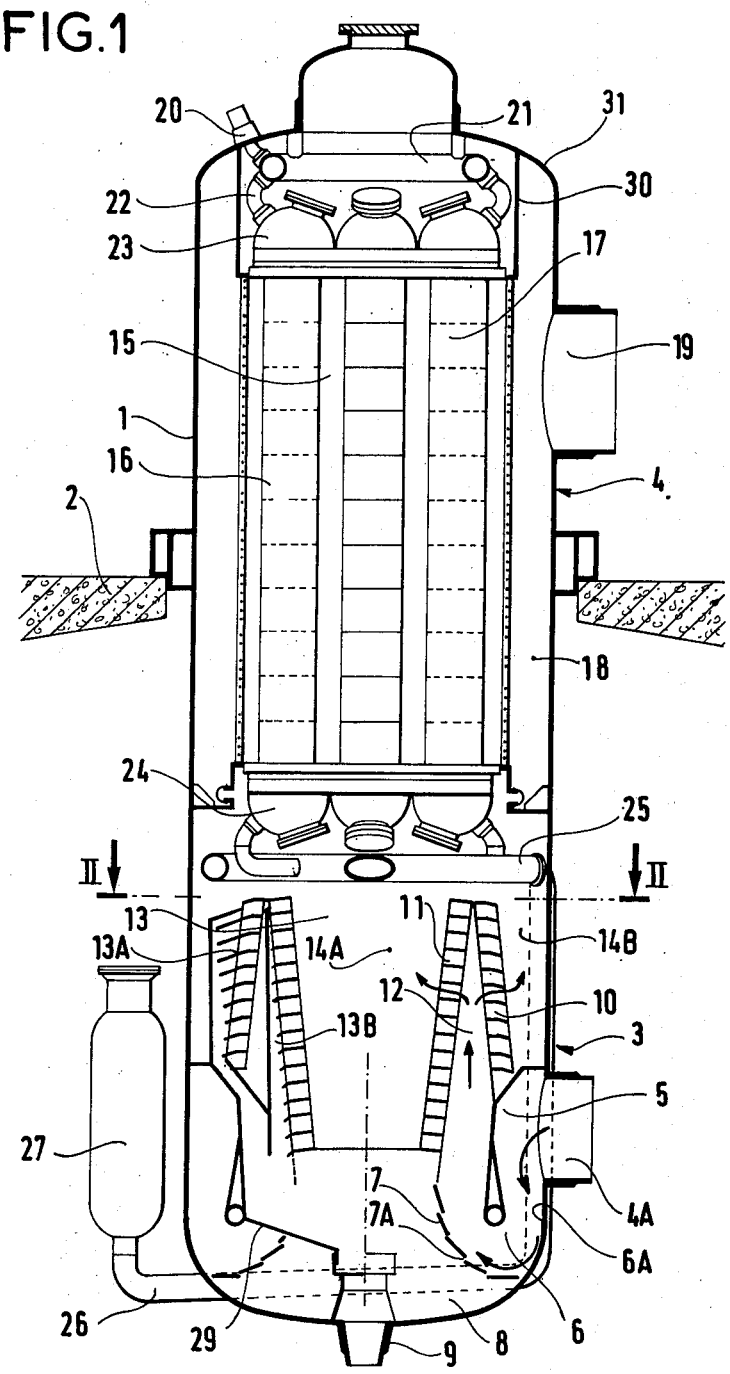
FIG. 1 is an axial cross-section along axis I—I of FIG. 2 of a separator-superheater in which the annular passage for letting wet steam into the superheater components goes down nearly to the bottom of the casing, part of which constitutes a wall of the passage.

In FIG. 1, the separator-superheater includes an outer pressure-resistant casing 1 supported by a conventional annular support resting of a floor 2. The separator-superheater has a lower portion 3 (which forms a separator) and an upper portion 4 (which forms a superheater). The lower portion is fitted with wet steam supply tubes 4A which communicate with an annular chamber 5 connected to the annular passage 6 which communicates with the separator components, bent at 180°. Part of the passage is formed by the wall 6A of the bottom of the casing. This allows the total height of the separator portion 3 to be reduced, but requires the wall 6A to be covered with stainless steel, like the rest of the wall of the passage, so as to prevent the phenomenon of erosion-corrosion by wet steam flowing at high speed. The other portion of the outer wall of the passage is constituted by metal sheets 7 which are angularly shifted with respect to the vertical axis and separated by interstices 7A at staggered levels. This causes preliminary separation of the droplets of water under the effect of centrifugal force which results from the change in direction of the steam. The water which is separated on the metal sheets 7 and flows through the interstices 7A collects in the bottom 8 with the water retained in the separator components, as will be set forth hereinafter, and flows out through the axial tubing 9.

The separator components are grouped together in two octogonal-based truncated pyramids, the outer pyramid 10 having its large base facing downwards and the inner pyramid 11 having its large base turned upwards, the large base of the inner pyramid being substantially in contact with the small base of the outer pyramid. Therefore, between the two pyramids, there is an annular gap 12 whose width decreases upwards, through which wet steam passes into the separator components which are analogous to those described in the earlier patent application.

Along the whole length of their outer ridges, the pyramids of separator components are provided with components such as 13A for the outer pyramid and 13B for the inner pyramid for removing the separated water. Vertical metal sheets and metal sheets 29 which are inclined towards the axis of the casing 1 collect the water and make it stream down into the bottom of the casing, above the outlet tubing 9.

The dry steam which leaves the separator components collects firstly in an axial zone 14A and secondly in a peripheral zone 14B. All the dry steam then rises into the upper superheater portion 4 which is similar to that described in the earlier patent application and will therefore not be described again in detail. It includes an axial zone 15 around which are disposed four nests of superheater tubes such as 16 and 17 which are fixed on the inner surface of a thin casing 30 which is itself welded by its upper edge to the upper edge 31 of the casing.

The nests of superheater tubes are supplied with high-pressure steam via a tube 20, a toroidal manifold 21 and connections 22 which communicate with end chambers 23. The high-pressure steam mostly condensed in nests of tubes such as 16 and 17 and reaching the end chambers 24 is collected in a manifold 25 then conveyed to the receiving cylinder 27 via a pipe 26.

Figure 2:
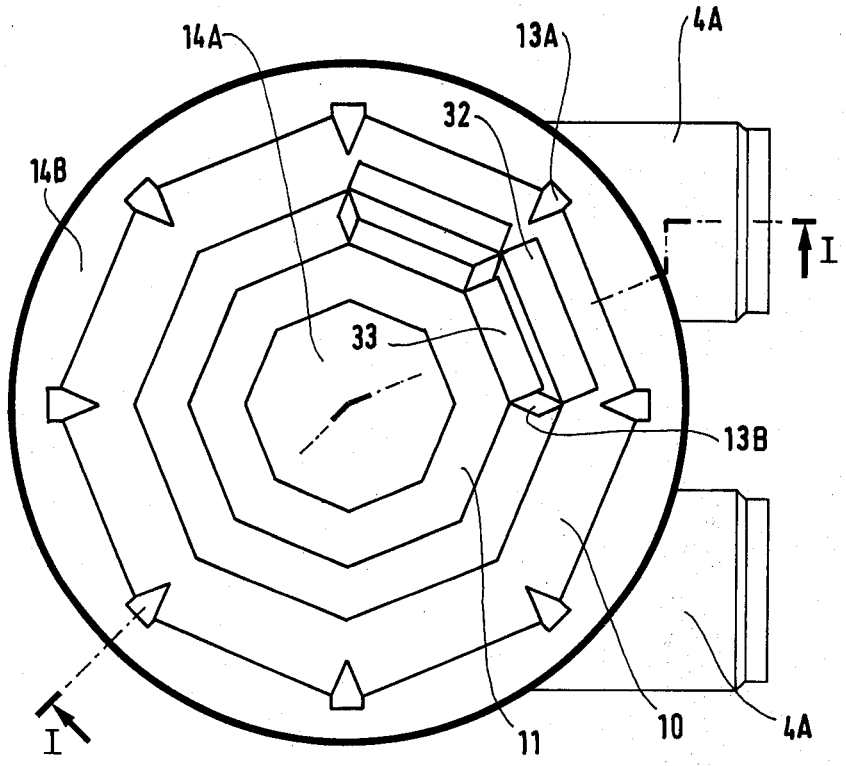
FIG. 2 is a diametral cross-section along axis II—II of FIG. 1.

FIG. 2 shows more precisely the disposition of separated water collecting units such as 13A and 13B respectively at the ridges of the outer and inner pyramids of the stacks of separator components, hence in the dead angles between the rectangular separators, only two of which are shown. This disposition reduces the available useful volume only slightly, while providing satisfactory flow of the separated water. The figure shows a separator 32 of the outer truncated pyramid and a separator 33 of the inner truncated pyramid. It is also seen that the separator system is symmetrical with respect to the vertical axis of the casing. The disadvantage of this is a slight dissymmetry in the discharge of steam via the separator components, but allows the wet steam inlet tubes such as 4A to be disposed at any point of the periphery of the casing, so as to reduce the length of the supply tubing and provides for the dry steam to flow symmetrically with respect to the vertical axis, as well as excellent access to all the walls for inspection and repairs both on the periphery of the outer pyramid and on that of the inner pyramid.

Figure 3:
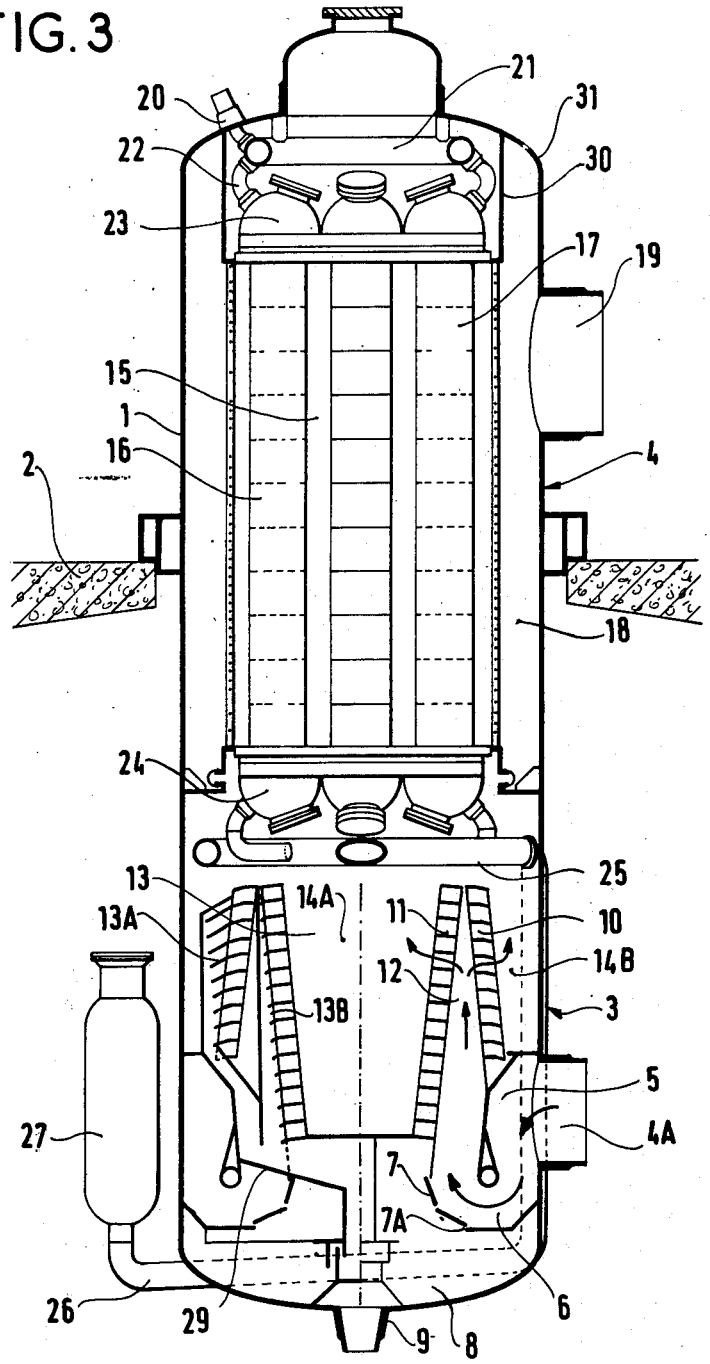
FIG. 3 is an axial cross-section of a separator-superheater in which the annular passage through which wet steam is let in is above the bottom of the casing.

FIG. 3 illustrates a separator-superheater analogous to the one in FIGS. 1 and 2, but in which the passage 6 of wet steam between the inlet tubes and the separator components is further from the bottom of the casing. Identical units are therefore not described again. In the present case, it is not necessary to dispose an inner coating of stainless steel on the portion of the bottom of the casing in contact with the in-coming wet steam. The passage 6 always deflects the wet steam through 180°. This allows preliminary separation of the droplets of water on the metal sheets 7 which delimit the passage and removal of the water through the interstices 7A between these metal sheets.

Although the separator-superheaters which have just been described with reference to the figures seem to be preferred embodiments, it will be understood that various modifications can be made thereto without going beyond the scope of the present invention, it being possible to replace some of their components by others which would perform an analogous technical function. In particular, the number of sides of the truncated pyramids formed by the stacks of separators can be less or greater than eight. Means can be provided for partially bleeding off dry steam before it is brought into the superheating zone.

We claim:

1. A vertical steam separator-superheater comprising a common casing (1) enclosing a lower portion (3) forming a speparation zone and an upper portion (4) forming a superheating zone, said separator-superheater further including an axial dry steam inlet zone (15), nests (16, 17) of superheating tubes disposed in envelopes spaced out round the central zone and fixed to a thin and flexible casing (30), said thin and flexible casing itself being fixed to the upper portion of the common casing and defining a peripheral superheated steam collection zone (18) the improvement wherein the lower portion includes an annular wet steam inlet chamber (5), wet steam inlet openings (4A) and separator components grouped in two coaxial truncated pyramids, said wet steam inlet openings being connected to said wet chamber, said pyramids including an outer pyramid (10) whose large base is lower than its small base and an inner pyramid (11) whose large base is higher than its small base, and wherein said annular inlet chamber communicates via an annular passage (6) with the volume contained between the outer pyramid and the inner pyramid.

2. A separator-superheater according to claim 1, wherein the annular passage which communicates the annular chamber with the volume between the outer pyramid and the inner pyramid bends about 180° and delimited on an inner side by angularly shifted metal sheets (7) separated by interstices (7A) which allow preliminary separation by centrifugal force of part of the water contained in the wet steam.

3. A separator-superheater according to claim 1, further comprising units 13A, 13B for allowing the water collected in the separator components to flow disposed at the ridges of the truncated pyramids.

4. A separator-superheater according to claim 1, wherein part of the annular passage is formed by the inner wall (6A) of the bottom of the common casing.

* * * * *